US011297983B2

(12) United States Patent
Bai

(10) Patent No.: US 11,297,983 B2
(45) Date of Patent: Apr. 12, 2022

(54) COUNTERMOUNT FOAM DISPENSER

(71) Applicant: Peter Bai, Placentia, CA (US)

(72) Inventor: Peter Bai, Placentia, CA (US)

( * ) Notice: Subject to any disclaimer, the term of this patent is extended or adjusted under 35 U.S.C. 154(b) by 0 days.

(21) Appl. No.: 16/740,146

(22) Filed: Jan. 10, 2020

(65) Prior Publication Data

US 2021/0059481 A1 Mar. 4, 2021

Related U.S. Application Data

(63) Continuation-in-part of application No. 16/559,234, filed on Sep. 3, 2019.

(51) Int. Cl.
*A47K 5/12* (2006.01)

(52) U.S. Cl.
CPC .... *A47K 5/1202* (2013.01); *A47K 2005/1218* (2013.01)

(58) Field of Classification Search
CPC ..... B65D 1/0246; B65D 1/023; B65D 41/16; B65D 41/06; B65D 43/22; B65D 45/305; B65D 45/30; A47K 5/06; A47K 5/14; A47K 5/1208; A47K 5/1215; A47K 2005/1218; A47K 5/16; F16L 37/107; B05B 7/0018
See application file for complete search history.

(56) References Cited

U.S. PATENT DOCUMENTS 1,789,338 A * 1/1931 Kooperstein ..... A47K 5/1205 222/385
2,772,116 A * 11/1956 Dobkin ..... B05B 11/02 222/190
2,885,125 A * 5/1959 Russell ..... B05B 11/0013 222/180
3,592,357 A * 7/1971 Welch ..... D06B 3/045 222/630
3,647,115 A * 3/1972 McCann ..... G01F 11/025 222/39
3,979,001 A * 9/1976 Bogert ..... B65D 50/043 215/217
4,280,638 A * 7/1981 Keihm ..... A47K 5/12 222/180
4,938,384 A * 7/1990 Pilolla ..... A47K 5/1205 222/333
6,142,342 A * 11/2000 Lewis ..... A47K 5/1205 222/180
6,202,980 B1 * 3/2001 Vincent ..... E03C 1/05 251/129.04
6,467,651 B1 * 10/2002 Muderlak ..... A47K 5/1217 222/333
6,929,150 B2 6/2005 Muderlak
7,025,227 B2 4/2006 Oliver et al.
(Continued)

*Primary Examiner* — Patrick M. Buechner
(74) *Attorney, Agent, or Firm* — Clement Cheng

(57) ABSTRACT

A countertop foam dispenser has a spout made of a spout extension front housing and a spout extension rear housing. The spout includes a spout nozzle with a spout opening. A spout mounting shaft is mounted to the spout at a mounting shaft bracket. A mixer pump housing has a spout retainer latch. The mixer pump housing houses a mixer pump. The mixer pump includes a motor. A retainer notch is formed on the lower portion of the spout. The retainer notch is configured to engage the spout retainer latch. A bottle contains liquid soap. The bottle has a connection to the mixer pump housing.

7 Claims, 14 Drawing Sheets

(56) References Cited

U.S. PATENT DOCUMENTS 7,364,053 B2 4/2008 Ophardt
7,621,426 B2 * 11/2009 Reynolds ..... B67D 7/348 222/325
8,100,299 B2 1/2012 Phelps
8,371,474 B2 2/2013 Tramontina
8,544,698 B2 10/2013 Ciavarella et al.
8,770,440 B2 7/2014 Lin
9,562,721 B2 * 2/2017 Muderlak ..... A47K 10/48
9,603,494 B1 * 3/2017 Wang ..... A47K 5/14
9,795,255 B2 10/2017 Rosko
10,278,549 B1 * 5/2019 Carignan ..... A47K 5/1211
2002/0185500 A1 * 12/2002 Muderlak ..... A47K 5/1217 222/1
2004/0245204 A1 * 12/2004 Suffa ..... B65D 41/16 215/224
2005/0087557 A1 * 4/2005 Oliver ..... A47K 5/1217 222/251
2007/0017932 A1 * 1/2007 Ciavarella ..... A47K 5/12 222/153.09
2009/0101679 A1 * 4/2009 Muderlak ..... A47K 5/16 222/375
2009/0152293 A1 6/2009 Sayers et al.
2009/0166381 A1 * 7/2009 Phelps ..... A47K 5/12 222/180
2012/0248129 A1 * 10/2012 Yoshida ..... B65D 43/0212 220/780
2013/0075354 A1 * 3/2013 Ungrady ..... B65D 1/023 215/43
2013/0075420 A1 * 3/2013 Tramontina ..... A47K 5/1205 222/1
2014/0027468 A1 * 1/2014 Lin ..... A47K 5/16 222/63
2014/0124540 A1 * 5/2014 Ciavarella ..... B05B 9/0872 222/190
2014/0231450 A1 * 8/2014 Rosko ..... A47K 5/1217 222/52
2014/0263421 A1 9/2014 Urban et al.
2015/0266630 A1 * 9/2015 Scott ..... B65D 41/0471 220/296
2015/0313421 A1 * 11/2015 Wang ..... A47K 5/1217 222/52
2016/0037975 A1 * 2/2016 Rice ..... F16L 25/14 222/372
2016/0256016 A1 9/2016 Yang
2016/0263604 A1 * 9/2016 Ramdhiansing ..... A47K 5/1211
2017/0112329 A1 * 4/2017 Babikian ..... A47K 5/1217
2017/0112332 A1 * 4/2017 Ciavarella ..... F04B 43/0054
2017/0136475 A1 * 5/2017 Twaroski ..... B05B 11/3028
2017/0156550 A1 * 6/2017 Ciavarella ..... B05B 7/0416
2017/0190563 A1 * 7/2017 Proper ..... B67D 7/0288
2020/0100628 A1 * 4/2020 Wang ..... A47K 5/14

* cited by examiner

COUNTERMOUNT FOAM DISPENSER

This application is a continuation in part of and claims priority from same inventor Peter Bai's co-pending U.S. utility patent Ser. No. 16/559,234 filed Sep. 3, 2019 also entitled Countermount Foam Dispenser, the disclosure of which is incorporated herein by reference.

FIELD OF THE INVENTION

The present invention is in the field of counter mounted foam dispensers.

DISCUSSION OF RELATED ART

A variety of different prior art references show countertop soap dispensers. For example, in the U.S. Pat. No. 9,795,255, Electronic Soap Dispenser by inventor Michael Scot Rosko, published Oct. 24, 2017 the abstract discloses, "An electronic soap dispenser includes an upper dispensing head supported above a sink deck, and a liquid soap reservoir and a pump assembly supported below the sink deck. A capacitive sensor is operably coupled to the dispensing head. A controller is in electrical communication with the capacitive sensor and activates the pump assembly in response to input from the capacitive sensor."

For example, in the U.S. Pat. No. 6,929,150, System And Method For Dispensing Soap by inventor Kenneth J. Muderlak, published Aug. 16, 2005 the abstract discloses, "A method of dispensing soap from a fluid dispensing system is disclosed. The method includes the steps of presenting a tube having a tube end disposed at a first position within an indented portion of a spout of the fluid dispensing system, sensing an object below the tube end, in response to sensing the object, expelling said soap from the tube end by drawing the tube end further within the indented portion to a second position, and returning the tube end to the first position"

For example, in the United States publication number 2009/0152293, Counter-Mounted Solution Dispenser With Counter-Protective Platform by inventor Richard C. Sayers, published Jun. 18, 2009 the abstract discloses, "A dispensing station is mounted to a counter and includes a container that is retained under the counter to hold a volume of no-rinse hand-treatment product. A protective platform is positioned on the top surface of the counter, and a faucet structure has an outlet positioned over the protective platform. A pump communicates with the volume of no-rinse hand-treatment product in the container, and a dispensing conduit extends through the faucet structure, communicating between the pump and the outlet of the faucet structure such that actuation of the pump causes no-rinse hand-treatment product to be dispensed at the outlet and directed toward the protective platform. This dispensing station will encourage the use of no-rinse hand-treatment products by providing a well-defined station, similar to the stations defined by common sinks."

For example, in the U.S. Pat. No. 8,544,698, Foam Dispenser With Stationary Dispensing Tube by inventor Nick E. Ciavarella, published Oct. 1, 2013 the abstract discloses, "Dispensers are provided including pumps for dispensing a foamed product out of an outlet provided in a dispensing tube. The foam is created from the mixing of a foamable liquid and air, with separate pumps being provided for each component. The dispensing tube is stationary, although the pumps themselves have parts that must move to dispense the foamed product. A single actuator operates both the liquid and air pumps. Additionally, in some embodiments, the air pump advances air before the liquid pump advances liquid. These pumps are particularly suited to the dispensing of a foamed skin care or skin sanitizing product."

For example, in the U.S. Pat. No. 7,364,053, Sink Side Touchless Foam Dispenser by inventor Heiner Ophardt, published Apr. 29, 2008 the abstract discloses, "A soap dispenser, preferably a sink side counter mounted dispenser, to dispense foamed liquid soap by mixing in an outlet of a soap spout liquid, soap and air preferably provided from a liquid soap pump and a air pump located remote from the faucet"

For example, in the U.S. Pat. No. 7,025,227, Electronic Soap Dispenser by inventor Steven R. Oliver, published Apr. 11, 2006 the abstract discloses, "A liquid soap dispenser includes a housing, a shank that engages a base of the housing, a soap path retainer disposed in the interior of the housing, a shank adapter disposed in the shank, and an infrared sensor to sense the presence of a user. A generally continuous passageway is defined through the shank adapter and the soap path retainer such that an elongated soap delivery tube of a liquid soap reservoir may be inserted through the passageway from the bottom of the soap dispenser to the spout end. The reservoir may be attached to the bottom end of the shank adapter. The soap path retainer is preferably formed of complementary halves, such as by plastic injection molding, that mate together to provide a curved passageway from near the base of the housing to the soap dispensing end and to support the sensor assembly."

For example, in the U.S. Pat. No. 8,100,299, Counter-Mounted Viscous Liquid Dispenser and Mounting System by inventor Stephen Lawrence Phelps, published Jan. 24, 2012 the abstract discloses, "The present invention provides an in-counter viscous liquid dispensing system. The features of the viscous liquid dispensing system include a quick mounting reservoir assembly that allows an installer to install the reservoir assembly in any orientation of the reservoir assembly to the counter mounted parts of the system. Other features include a mounting system which allows an installer to install the in-counter dispensing system without the need to work both above and below the counter top."

For example, in the U.S. Pat. No. 8,371,474, Fluid Dispenser by inventor Paul Francis Tramontina, published Feb. 12, 2013 the abstract discloses, "The invention is a method of dispensing a fluid and a dispenser which will dispense an appropriate amount of fluid to effectively clean a user's hand, even if the dispenser is inactive for a period of time."

For example, in the United States publication number 2014/0263421A1, Counter Mount Above-Counter Fill Dispensing System And Refill Units for Same by inventor Scott E. Urban, published Sep. 18, 2014 the abstract discloses, "Exemplary embodiments of dispensing systems and refill units for dispensing systems are provided. One exemplary refill unit for a counter mount dispenser includes a collapsed bag and a tube extending down into the collapsed bag. A fitment is secured to the collapsed bag. The fitment has a filling orifice. A pump for pumping fluid out of the bag is also provided. The collapsed bag fits through an opening in a countertop so that the collapsed bag may be inserted from above the countertop through the opening and at least a part of the collapsed bag extends below the countertop. The collapsed bag is configured to be filled with a liquid after being inserted through the opening in the countertop and the volume of the collapsed bag expands when the collapsed bag is filled with liquid."

For example, in the U.S. Pat. No. 8,770,440, Countertop Automatic Foam Soap Dispenser by inventor Moses-B. Lin, published Jul. 8, 2014 the abstract discloses, "A countertop automatic foam soap dispenser includes an automatic foam soap dispenser body, a soap liquid container, a circular connecting tube and a battery compartment. The soap liquid container is filled with an appropriate quantity of liquid soap. The battery compartment supplies electric power to the automatic foam soap dispenser body. The automatic foam soap dispenser body is passed through the circular connecting tube by a soap transmission tube and installed to the bottom inside the soap liquid container. The automatic foam soap dispenser body includes a foam soap valve, a control circuit board, a sensor, a motor controlled by the control circuit board, and a transmission gear set. When a user's hand approaches a sensor of the automatic foam soap dispenser body, the motor drives a cam of the transmission gear set to rotate and compress a foam soap valve to supply the appropriate quantity of foam soap."

Also for example, in the United States patent publication 2016/0256016, entitled Foaming Soap Dispensers by inventor Yang, published Sep. 8, 2016, shows a soap pump with a membrane type pump unit. The Yang application was issued as U.S. Pat. No. 10,076,216 on Sep. 18, 2018 entitled Foaming Soap Dispensers. The Yang device has a drawback that the membrane used can become loose and lead to leakage of liquid into the motor area. The above references are incorporated herein by reference.

SUMMARY OF THE INVENTION

A countertop foam dispenser has a spout made of a spout extension front housing and a spout extension rear housing. The spout includes a spout nozzle with a spout opening. A spout mounting shaft is mounted to the spout at a mounting shaft bracket. A mixer pump housing has a spout retainer latch. The mixer pump housing houses a mixer pump. The mixer pump includes a motor. A retainer notch is formed on the lower portion of the spout. The retainer notch is configured to engage the spout retainer latch. A bottle contains liquid soap. The bottle has a connection to the mixer pump housing.

Batteries are housed in the mixer pump housing. The batteries power the mixer pump for extracting liquid soap from the bottle. The batteries also power a circuit board mounted in the mixer pump housing, and the batteries also power a sensor. The sensor is mounted to the spout extension front housing. The mixer pump housing also has a battery tray for retaining the batteries. The battery tray has a tray door latch cam with a pair of indents, namely a first latch indent and a second latch indent. The pair of indents receive respectively a first key protrusion and a second key protrusion formed on a tray door key. The tray door latch cam travels between a closed position and an open position during a rotation of the tray door latch cam.

The bottle further includes a bottle sidewall extending vertically and a shoulder extending from the bottle sidewall at an upper portion of the bottle. A bottle neck extends upwardly from the shoulder. The bottle neck includes a neck groove interrupted by a rotation stop. The rotation stop is formed as a protrusion that protrudes horizontally away from the neck. An adapter mounted to the bottle neck. The adapter has an adapter sidewall. The adapter sidewall includes adapter protrusions extending away from the sidewall. The adapter includes adapter hooks configured to permanently snap to the neck groove and form a seal between the neck and the adapter. An adapter gasket has an adapter port opening for forming a seal. The adapter gasket is mounted to an adapter port of the adapter. The adapter is configured to mount to a bottle adapter receiver frame.

The mixer pump housing also has a bottle adapter receiver frame. The bottle adapter receiver frame includes a bottle adapter receiver with bottle adapter retainer slots. The bottle adapter retainer slots include a bottle adapter intake funnel and a bottle adapter retainer bump. Preferably, the batteries are retained on a battery tray that is locked with a battery tray key. The battery tray key rotates the tray door latch cam. The tray door latch cam has a circular profile.

The mixer pump housing further includes an upper alignment indent formed on a bottle adapter receiver frame. The upper alignment indent forms an upper alignment edge. The bottle further includes a lower alignment indent forming a lower alignment indent edge. The upper alignment edge and the lower alignment edge align when the bottle is in an engaged position.

The motor includes a motor shaft which has a crank. The crank actuates a piston handle, and the piston handle depresses a piston diaphragm at piston diagram tips. The piston diaphragm tips are configured to change the volume of the piston diaphragm when the piston handle depresses the piston diaphragm. The piston diaphragm is connected to an output nozzle cover via a filter net assembly. The piston diaphragm is configured to change the pressure against an output cover. The piston diaphragm aspirates air from an air inlet port, and blows the air to mix the air with liquid soap at a mixer separated from the piston diaphragm.

The diaphragm is mounted to the mixer pump. The diaphragm has three diaphragm cups, namely a first diaphragm cup, a second diaphragm cup, and a third diaphragm cup. The first diaphragm cup is configured to pump air, and the second diaphragm cup is configured to pump air. The third diaphragm cup is configured to pump liquid. The diaphragm pumps both liquid and air without mixing the liquid with the air. A mixer is located in the spout. The mixer receives pressurized air from the mixer pump. The mixer receives pressurized liquid from the mixer pump. The pressurized air and the pressurized liquid mix to form a foam.

A partition pump manifold has an air partition and a liquid partition. The liquid partition segments a liquid conduit proximal portion from a liquid conduit distal portion. The air partition segments and air conduit proximal portion from an air conduit distal portion. An adapter is mounted to the bottle neck which may have adapter protrusions extending away from the bottle neck. The adapter includes adapter hooks configured to permanently snap to the neck groove and form a seal between the neck and the adapter.

Figure 1:
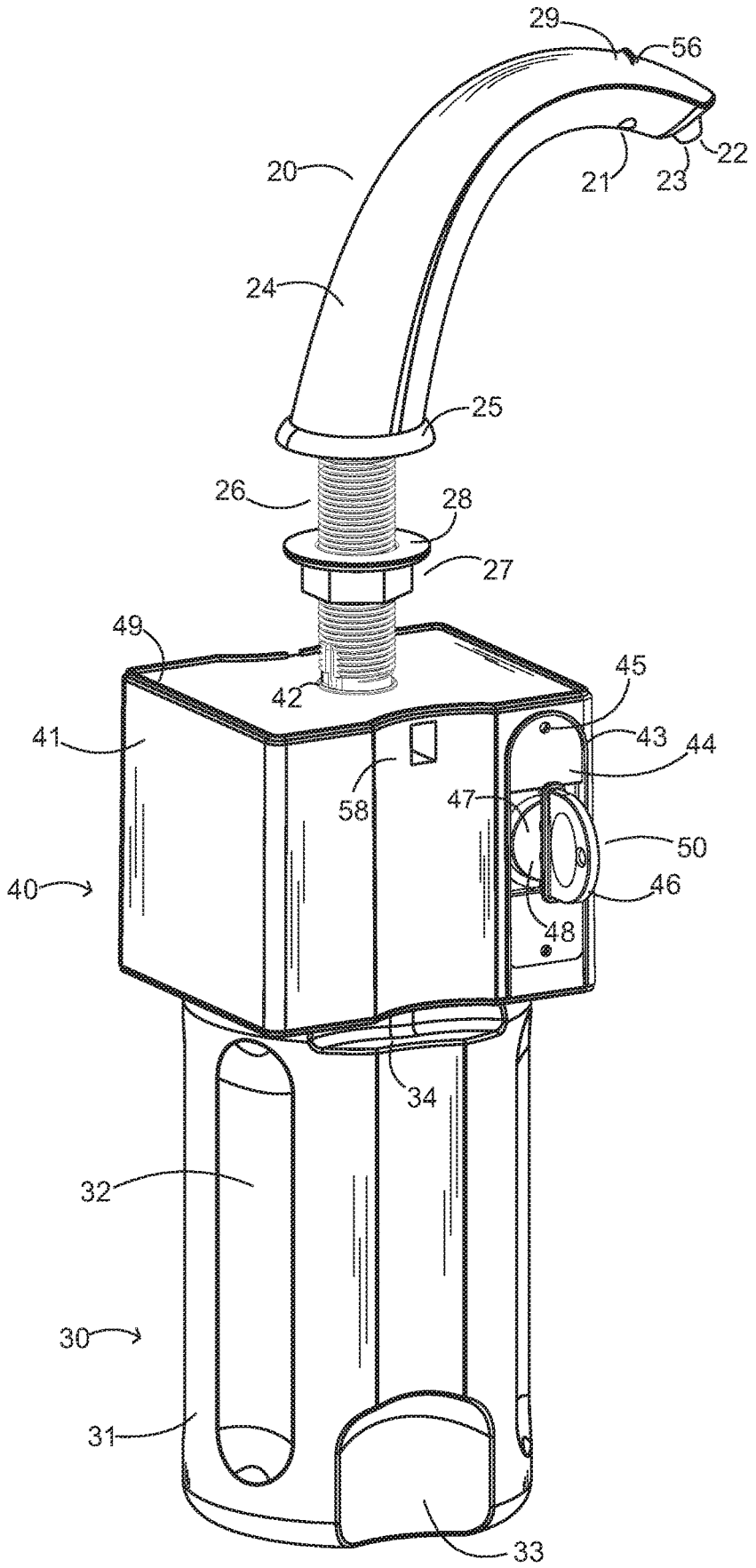
FIG. 1 is a perspective view.

The following call out list of elements can be a useful guide in referencing the elements of the drawings.

20 Spout
21 Spout Sensor
22 Spout Nozzle
23 Spout Nozzle Opening
24 Spout Extension
25 Spout Shoulder
26 Spout Mounting Shaft
27 Mounting Shaft Nut
28 Nut Flare
29 Forward Sensor
30 Bottle
31 Side Wall
32 Sidewall Indent Grip
33 Lower Depression
34 Upper Depression
35 Bottle Adapter
36 Adapter Protrusion
37 Adapter Port
38 Adapter Port Opening
39 Bottle Shoulder
40 Mixer Pump
41 Mixer Pump Housing
42 Pump Outlet Opening
43 Battery Door
44 Battery Tray
45 Tray Door Opening
46 Tray Door Key Handle
47 Tray Door Latch
48 Tray Door Latch Cam
49 Mixer Pump Housing Top Face
50 Tray Door Key
51 First Key Protrusion
52 Second Key Protrusion
53 First Latch Indent
54 Second Latch Indent
55 Key Handle Opening
56 Indicator
57 Mixer Housing Connector
58 Mixing Housing Connector Opening
59 Mixer Housing Connector Tab
60 Lower Port
61 Spout Extension Front Housing
62 Spout Extension Rear Housing
63 Sensor Bracket
64 Shoulder Gasket
65 Bottle Adapter Receiver Frame
66 Foam Screen
67 Motor
68 Motor Mount
69 Water Proof Gasket
70 Flow Control Fittings
71 Liquid Inlet Nozzle
72 Adapter Gasket
73 Battery
74 Battery Slots
75 Tray Opening
76 Circuit Board
77 Mounting Shaft Bracket
78 Spout Retainer Latch
79 Retainer Notch
80 Alignment System
81 Bottle Adapter Receiver
82 Bottle Adapter Receiver Sidewall
83 Bottle Adapter Intake Funnel
84 Bottle Adapter Retainer Bump
85 Adapter Sidewall
86 Adapter Hooks
87 Neck Groove
88 Rotation Stop
89 Bottle Adapter Retainer Slot
90 Bottle Neck
91 Upper Alignment Indent
92 Upper Alignment Edge
93 Lower Alignment Indent
94 Lower Alignment Edge
95 Liquid Inlet Nozzle Tubing Connector
100 Pump Assembly
101 Output Cover
102 Rubber Stopper
103 Filter Net
104 Piston Diaphragm
105 Piston Bracket
106 Piston Handle
107 Crank
108 Tailstock
109 Motor Housing
110 Motor Shaft
111 Motor Shaft Mounting Opening
112 Piston Handle Shaft Opening
113 Piston Handle Shaft
114 Piston Handle Arms
115 Piston Handle Diaphragm Engagement
116 Piston Diaphragm Tips
117 Piston Diaphragm Cups
118 Foam Outlet Port
119 Liquid Inlet Port
120 Air Inlet Port
121 Air Outlet Port
122 Mixer
130 Swivel Socket Connector
131 First Swivel Hose
132 Second Swivel Hose
133 First Swivel Nipple
134 Second Swivel Nipple
135 Swivel Socket Circlip
136 Swivel Socket Flange
137 Upper Circlip Edge
138 Lower Circlip Edge
140 partition pump manifold 140
141 Air Conduit
142 Liquid Conduit
143 Air Partition
144 First Liquid Port
145 First Air Port
146 Second Air Port
147 Second Liquid Port
148 Liquid Partition
150 Mixing Socket
151 First Mixing Socket Nipple
152 Second Mixing Socket Nipple
153 Mixing Socket Body
154 Mixing Chamber Housing
155 Nozzle Mount
161 elastomeric seal
162 First Diaphragm Distal Air Opening
163 First Diaphragm Proximal Air Opening
164 Second Diaphragm Proximal Air Opening

165 Second Diaphragm Distal Air Opening
166 Third Diaphragm Distal Liquid Opening
167 Third Diaphragm Proximal Liquid Opening
181 Air Conduit Proximal Portion
182 Air Conduit Distal Portion
183 Liquid Conduit Proximal Portion
184 Liquid Conduit Distal Portion
191 First Diaphragm Cup
192 Second Diaphragm Cup
193 Third Diaphragm Cup
194 Adapter

DETAILED DESCRIPTION OF THE PREFERRED EMBODIMENT

As seen in FIG. 1, a spout 20 is configured to extend from a countertop by a spout extension 24 and dispense a flow of foam soap for a user. The spout 20 includes a spout sensor 21 which can be an infrared device or other type of proximity sensor. The spout sensor 21 is mounted to an underside of the spout 20. The spout nozzle 22 extends from a terminal tip of the spout 20. The spout nozzle 22 has a spout nozzle opening 23. The spout extension 24 has a lower end that forms a base. The spout shoulder 25 is configured to abut the countertop. Optionally, the spout 20 also preferably includes a forward sensor 29 that is directed forward and senses for the presence of a user. An indicator 56 can be mounted in an opening that receives the forward sensor 29 so that the user can see the operational status of the countertop dispenser.

A spout mounting shaft 26 extends downwardly from the spout extension 24. A mounting shaft nut 27 is threaded to the spout mounting shaft and has a nut flare 28 that contains a lower surface of the countertop underneath the countertop. The spout mounting shaft 26 extends downwardly to a pump outlet opening 42 to allow the spout mounting shaft 26 2 connected to the mixer pump 40.

The mixer pump 40 has a mixer pump housing 41 which includes the pump outlet housing 42. The mixer pump housing 41 includes a battery door 43 attached to a battery tray 44. The tray door opening 45 is formed on the battery door 43 and is configured to receive a connector such as a security screw that retains the battery tray door 43. The tray door has a tray door latch 47 actuated by a tray door latch cam 48. The tray door latch cam 48 has a slot for receiving a tray door key. The tray door key 50 as a tray door key handle 46 that when turned can actuate the tray door latch cam 48. The tray door key 50 has a security engagement to the tray door latch cam 48, such as by a pair of nonstandard prongs. The mixer pump housing 41 also includes a mixing housing connector opening 58 that shape to receive a security screw. The mixing housing connector opening 58 allows a connector to retain together a pair of sections of the mixer pump housing 41 such as the 49 mixer pump housing top face and the lower portion of the mixer pump housing.

The bottle 30 is connected to an underside of the mixer pump housing 41. The bottle 30 has a sidewall 31 with a sidewall indent grip 32 that improves structural rigidity. The bottle 30 has a lower depression 33 and an upper depression 34 also to improve structural rigidity.

Figure 2:
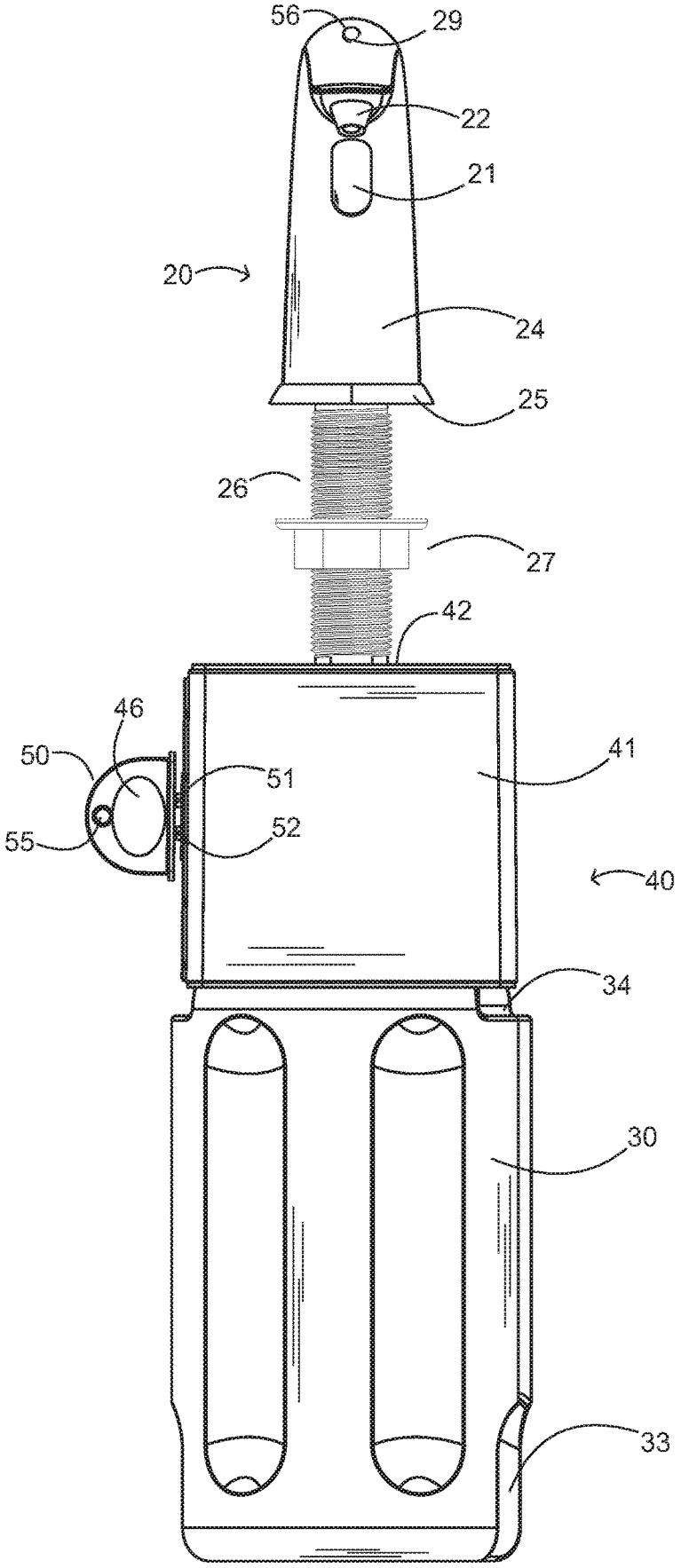
FIG. 2 is a front view.

As seen in FIG. 2, the spout 20 has a forward facing spout sensor 21 that is pill shaped and elongated. The spout sensor 21 has a lens providing a continuous flush external surface with the spout 20. The spout nozzle 22 is a frustroconical protrusion extending downward from the spout 20. The spout extension 24 is generally centered to the spout mounting shaft 26 and the spout shoulder 25. The mounting shaft nut 27 can be made of metal or plastic and configured to rotate and tighten onto a mounting opening formed in the countertop. The forward sensor 29 is mounted inside the spout 20 and also has a flush lens that allows the forward sensor 29 to detect the presence of a user. The forward sensor 29 can work in conjunction with the spout sensor 21 so that the spout only activates when both sensors sense a presence. The spout sensor 21 senses the presence of the user's hands, and the forward sensor 29 senses the presence of a user's torso. The indicator 56 can be mounted in the same opening as the forward sensor 29.

The tray door key handle 46 is preferably rounded. The 50 tray door key may have a first key protrusion 51 and a second key protrusion 52. A key handle opening 55 may allow connection to a lanyard or other line. The pair of key protrusion, namely the first key protrusion 51 and the second key protrusion 52 are required to allow the turning of the tray door latch cam 48.

Figure 3:
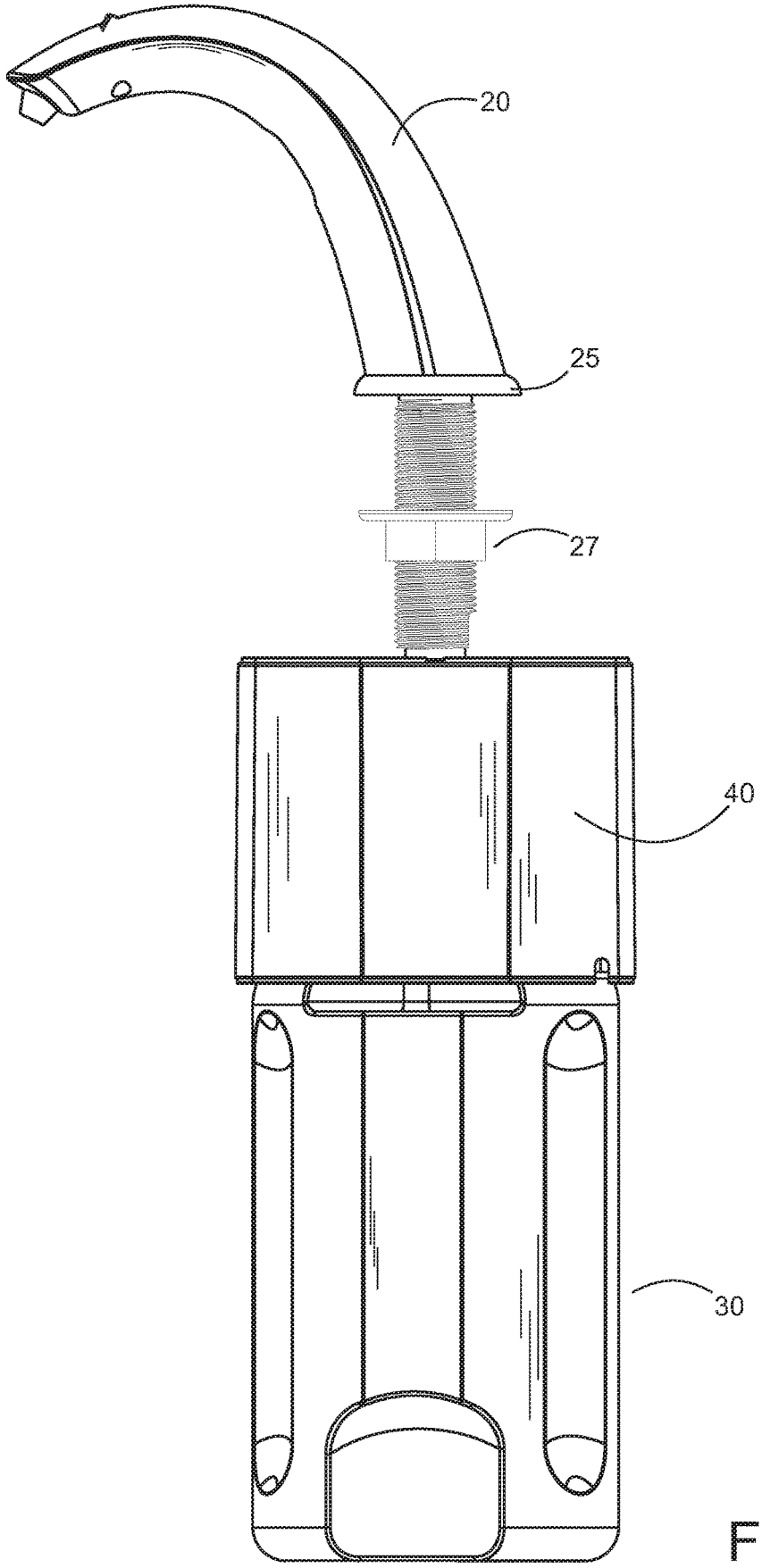
FIG. 3 is a right side view.

As seen in FIG. 3, the spout 20 can have a curved profile that extends at an angle from the spout shoulder 25. The mounting shaft nut 27 is preferably hexagonal. The bottle 30 mounts to the mixer pump in a single action.

Figure 4:
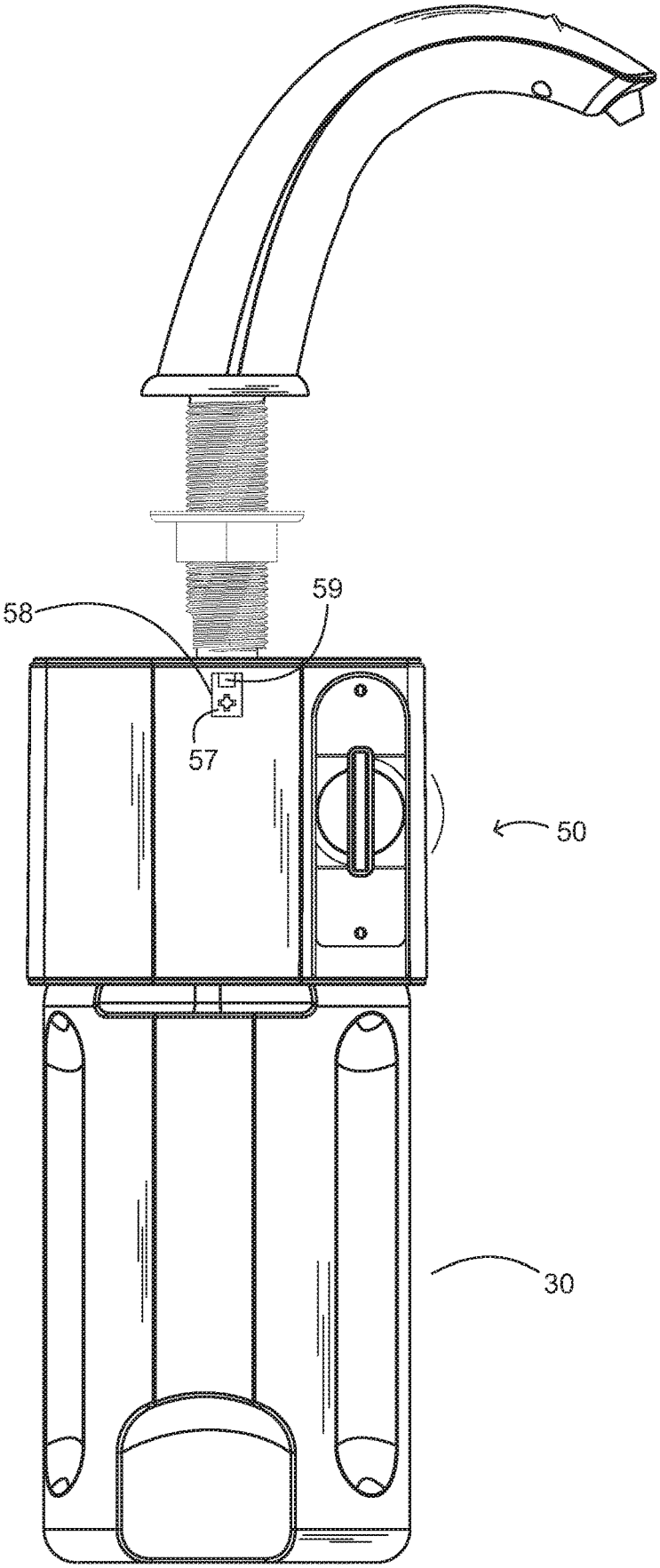
FIG. 4 is a left side view.

As seen in FIG. 4, the tray door key 50 allows access to the battery tray and is next to the mixer housing connector 57. The mixer housing connector 57 preferably includes a mixer housing connector opening 58 and may have mixer housing connector tab 59. The mixer housing connector tab 59 can be formed as a latch that has a snap connection between the different parts of the mixer housing.

Figure 5:
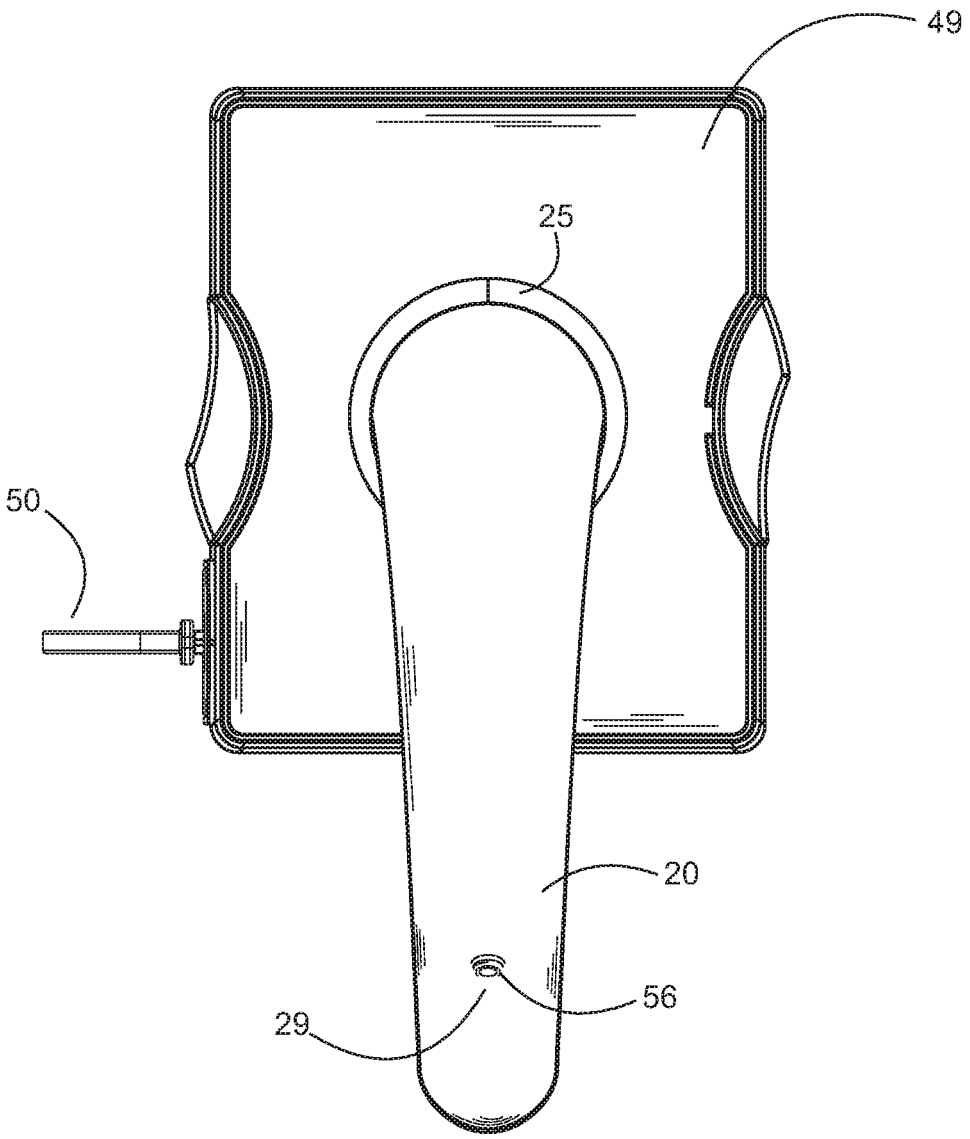
FIG. 5 is a top view.

As seen in FIG. 5, the spout 20 extends forward, and the spout shoulder 25 can form a seal with the countertop. The forward sensor 29 is perpendicular to the extension of the spout. The mixer pump housing top face 49 is preferably rectangular. The tray door key 50 can extend laterally from the left side of the mixer pump housing. The indicator 56 is also disposed forwardly to provide an indication to the user.

Figure 6:
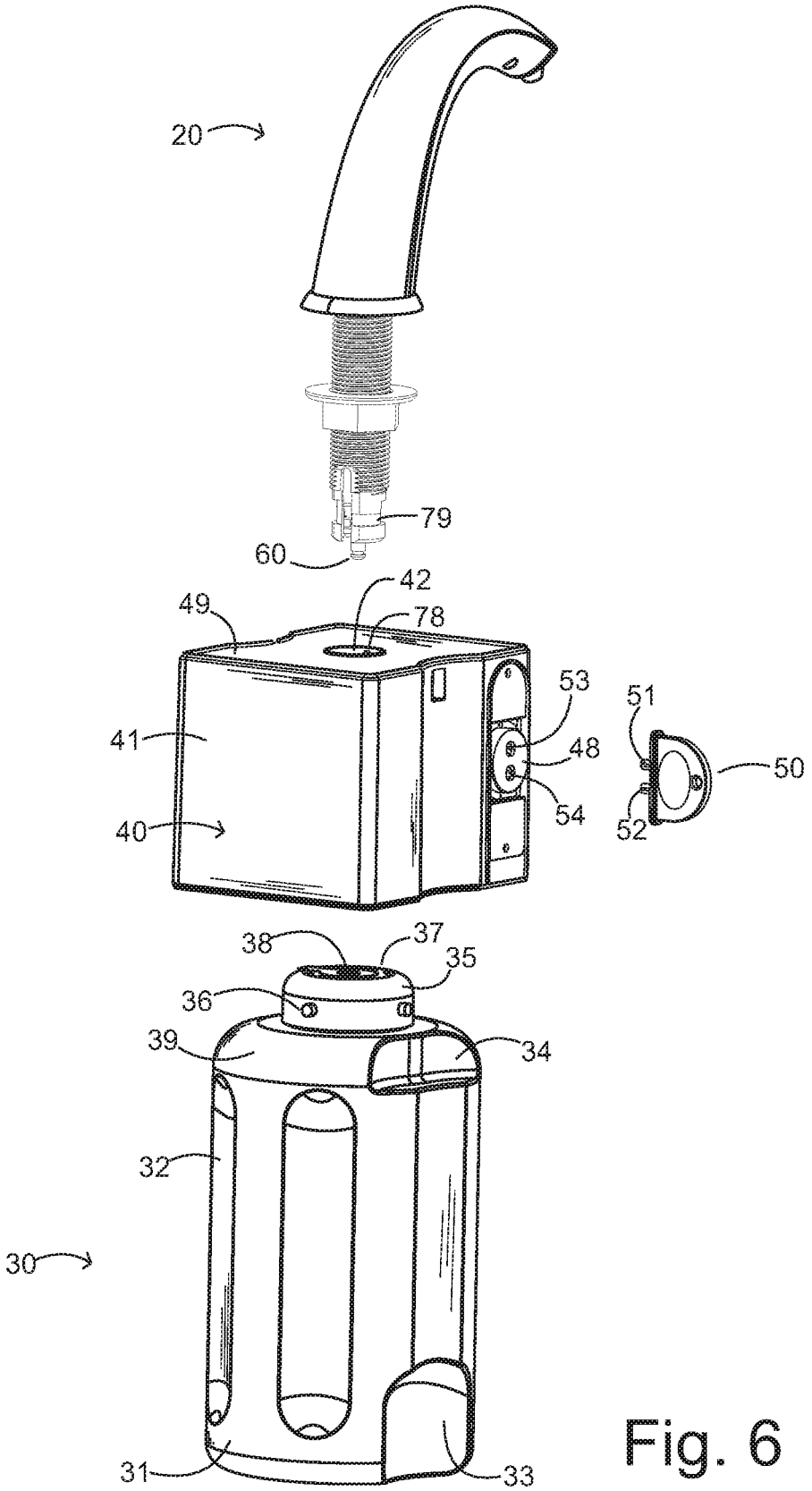
FIG. 6 is an exploded view.

As seen in FIG. 6, the spout 20 may have a lower port 60 with an annular relief that allows installation of an elastomeric ring seal. The mixer housing connector tab 59 can release a spout retainer latch 78 in the pump outlet opening 42 so as to release the lower port 60 of the spout 20. The spout retainer latch 78 may retain the lower port 60 at a retainer notch 79. The spout retainer latch 78 preferably allows a snap connection of the spout 20 to the pump outlet opening 42. In this way, a user can first mount the spout 20 using the nut in a first step and then in a second step snap on the spout retainer latch 78 to the retainer notch 79 thereby engaging the pump outlet opening 42 the spout 20 in a pair of separate steps.

The user can attach the bottle 30 after attaching the pump outlet opening 42 to the lower port 60. The user grasps the sidewall 31 of the bottle 30 by a variety of sidewall indent grips 32. The user may also use the lower depression 33 or the upper depression 34. The bottle 30 has a bottle adapter 35 mounted above a bottle shoulder 39. The bottle adapter 35 snaps to the neck of the bottle and creates a watertight permanent seal to the bottle. The bottle adapter 35 preferably has four adapter protrusions 36 that are oriented at 90° from each other and extend away from a vertical sidewall of the bottle adapter 35. The bottle adapter 35 has an adapter port 37 with an adapter port opening 38.

The mixer pump 40 mixes water and air inside the mixer pump housing 41. The resulting foam soap is expelled through the pump outlet opening 42 and through the spout 20. The tray door latch cam 48 has a pair of depressions that receive a pair of protrusions of the tray door key 50. The tray door key 50 has a first key protrusion 51 and a second key protrusion 52. The tray door latch cam 48 has a first latch indent 53 and a second latch indent 54 that receive the pair of protrusion of the tray door key 50. When both protrusions insert into both depressions, the latch can be turned to unlock the battery tray door. The battery tray door and battery compartment is preferably watertight.

Figure 7:
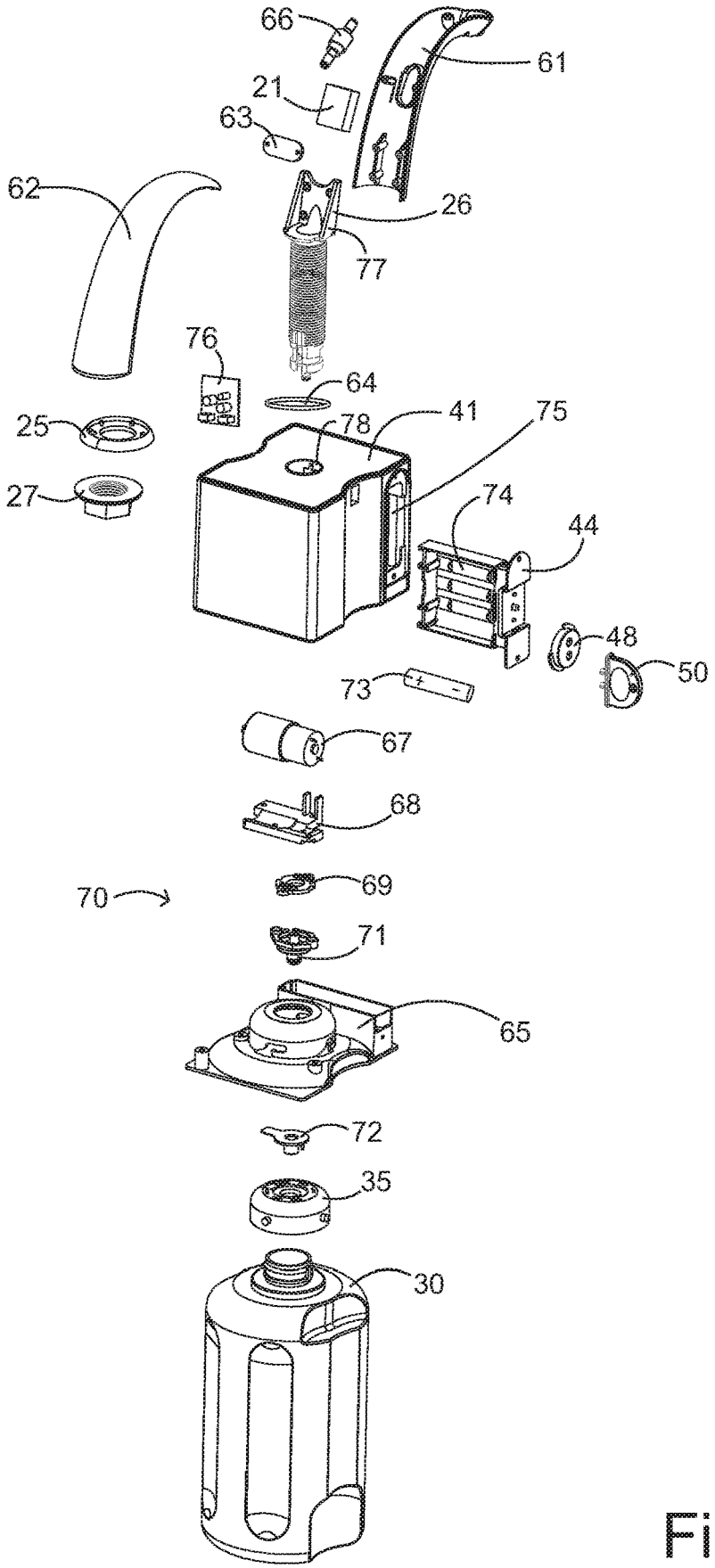
FIG. 7 is a detailed exploded view.
Figure 8:
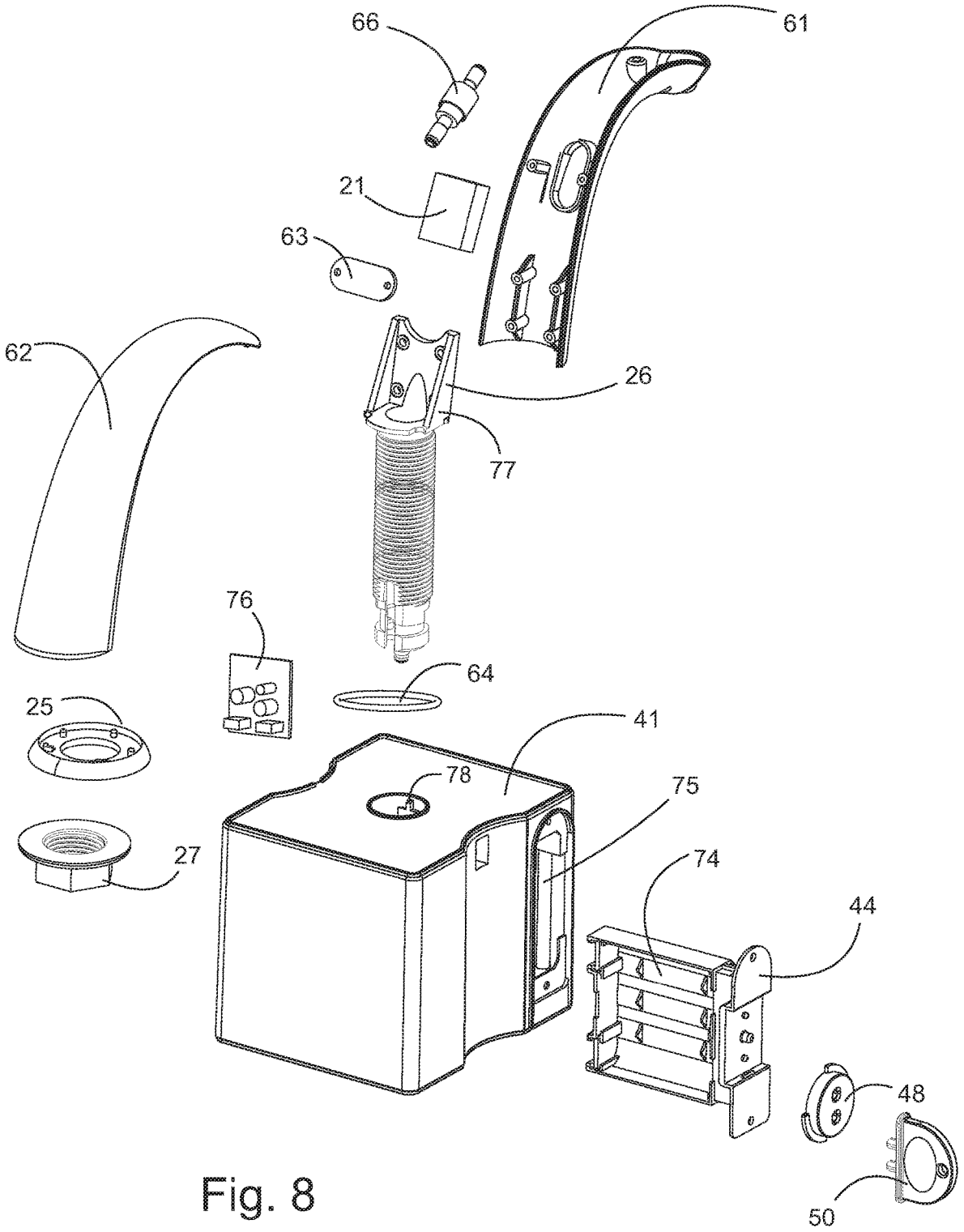
FIG. 8 is an enlarged detailed exploded view of the upper portion of FIG. 7.

As seen in FIG. 7, a variety of internal components reside within the various housings. The spout sensor 21 is mounted between a spout extension front housing 61 and a spout extension rear housing 62. A sensor bracket 63 can mount on mounting posts of the spout extension front housing 61 and thus retain the spout sensor 21 to the spout extension front housing 61. Similarly, a foam screen 66 can remix rough foam into finer foam and can be mounted in the cavity between the spout extension front housing 1 and the spout extension rear housing 62. The spout shoulder 25 can retain the lower semicircular edges of the pair of spout extension housings. The spout mounting shaft 26 has a mounting shaft bracket 77 that secures to the spout extension front housing 61. A shoulder gasket 64 can seal the spout shoulder 25.

The bottle 30 holds soap in liquid form and receives a bottle adapter 35. The bottle adapter 35 adapts to an adapter gasket 72. The adapter gasket 72 secures to a bottle adapter receiver frame 65 formed as a lower portion of the mixer pump housing 41. The bottle adapter receiver also forms a lower portion of the battery tray slot and may define a portion of the tray opening 75. The battery tray 44 receives batteries 73 in battery slots 74 and is secured by the tray door latch cam 48 with the tray door key 50. The battery system powers a circuit board 76.

The battery powers a motor 67 that is mounted to a motor mount 68. A variety of flow control fittings 70 prevents leaks while allowing single-handed quick connection. A water proof gasket 69 made of an elastomeric material seals a liquid inlet nozzle 71. The liquid inlet nozzle 71 is mounted to the bottle adapter receiver frame 65 and sealed against the adapter gasket.

Figure 9:
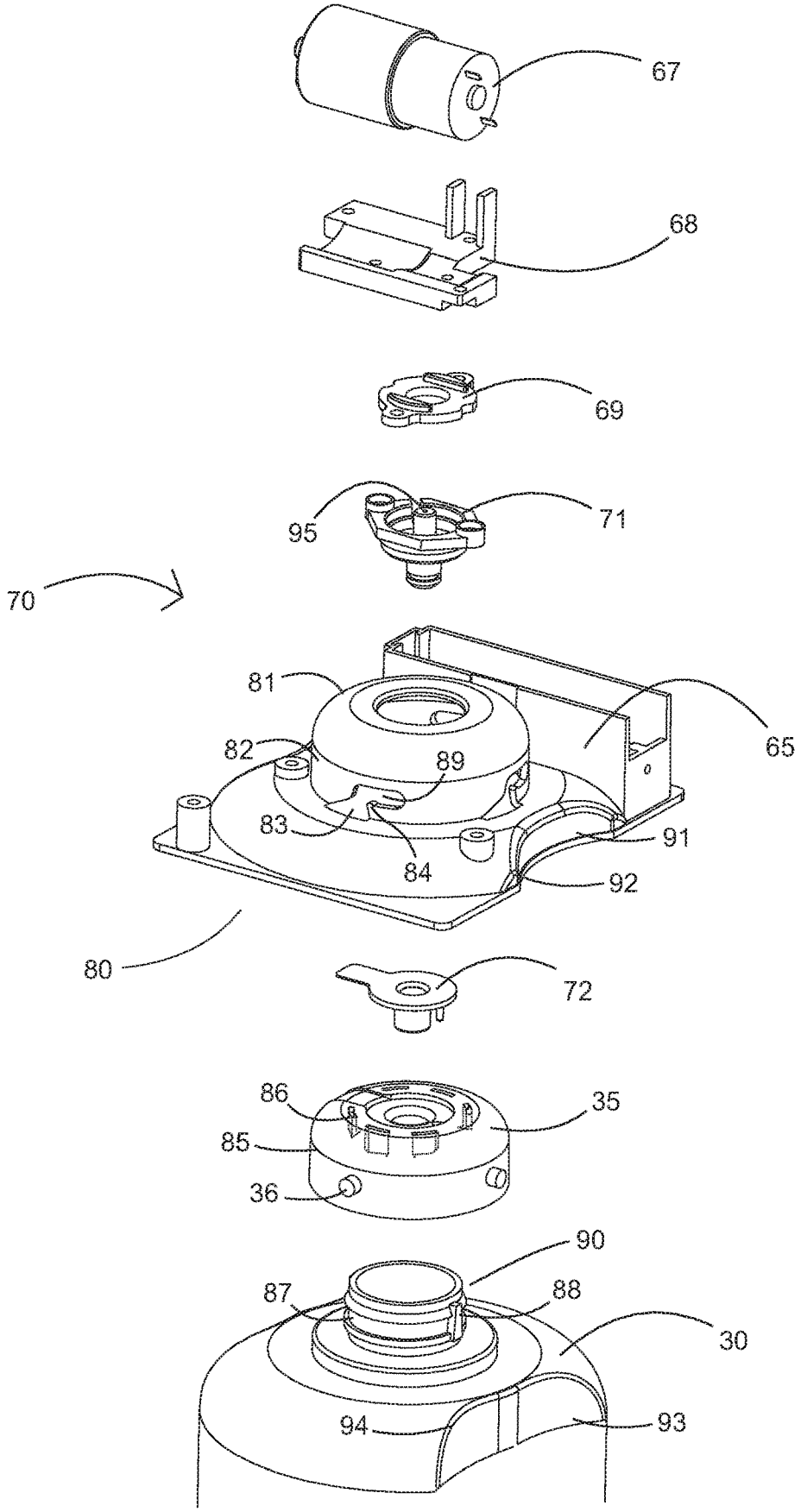
FIG. 9 is an enlarged detailed exploded view of the lower portion of FIG. 7.

As seen in FIG. 9, an alignment system 80 includes indents and slots for retaining the bottle 30 at the bottle neck 90. The bottle adapter receiver 81 is a hollow indented portion of the bottle adapter receiver frame 65, and is shaped to receive the bottle adapter 35. The adapter protrusion 36 engage to the bottle adapter receiver sidewall 82. The adapter protrusions 36 have a circular cylindrical profile that extend horizontally away from the bottle adapter. The adapter protrusions 36 engage a bottle adapter intake funnel 83 and rotate clockwise to pass over a bottle adapter retainer bump 84. The bottle adapter intake funnel 83 and the bottle adapter retainer bump 84 are formed on the bottle adapter retainer slot 89. The bottle adapter retainer slot 89 is formed on the bottle adapter receiver sidewall 82.

The alignment system 80 also includes an alignment for the bottle. The bottle adapter 35 has an adapter sidewall 85. The bottle adapter 35 has downwardly protruding adapter hooks 86. The adapter hooks 86 engage to a neck groove 87 formed on a neck of the bottle. A rotation stop 88 breaks the continuity of the neck grooves 87 so that the adapter hooks 86 will abut the rotation stop 88 when the adapter protrusions 36 are engaged to the bottle adapter retainer bump 84. As liquid is drawn upward from the bottle 30, air intake is entrained within the flow of liquid to make rough foam. As the rough foam travels upward, it can pass through additional screening or mixing to screen into finer foam.

Preferably, an upper alignment indent 91 formed on the bottle adapter receiver frame 65 has an upper alignment edge 92. The upper alignment edge 92 aligned with a lower alignment edge 94. The lower alignment edge 94 is formed on a lower alignment indent 93 which is disposed on the bottle 30. The pair of aligning alignment edges allows a user to uninstall and install the bottle from the bottle adapter receiver frame 65 without direct line of sight, using only touch. The upper alignment indent 91 holds the lower alignment indent 93 so that the inside surface of the upper alignment indent 91 abuts the outside surface of the lower alignment indent 93. Thus, the alignment indents key the bottle to the bottle adapter receiver 81. The bottle adapter receiver 81 only receives the bottle that has the matching alignment indent. The alignment indent on the bottle is formed on the bottle shoulder. The bottle shoulder may be slightly flexible for allowing it to rotate into the bottle adapter receiver 81 where the pair of alignment indents engage.

Figure 10:
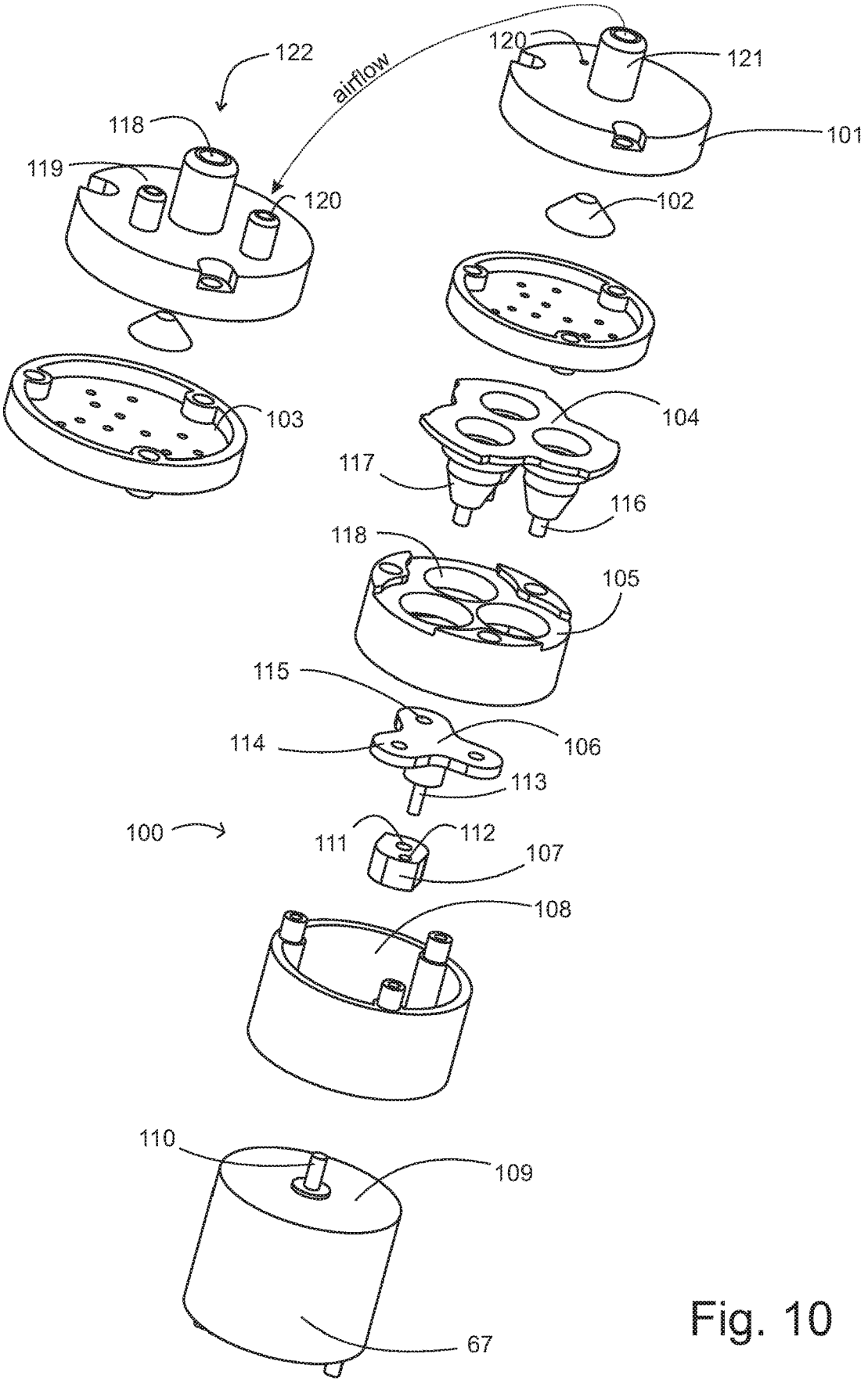
FIG. 10 is an exploded view of the pump and mixer assemblies.

As seen in FIG. 10, the motor 67 is part of a pump assembly 100. The motor 67 has a motor housing 109 and a motor shaft 110 extending from the motor housing 109. The motor shaft 110 extends into a tailstock 108. The tailstock 108 is a housing that holds a crank 107 and a piston handle. The crank 107 has a motor shaft mounting opening 111. The motor shaft mounting opening 111 is offset from a piston handle shaft opening 112. The crank 107 has a piston handle shaft opening 112 that retains a piston handle shaft 113. The piston handle shaft 113 wobbles cyclically about the motor shaft 110 and has an angle to the motor shaft 110. The piston handle 106 has three extending piston handle arms 114. Each of the piston handle arms have a piston handle diaphragm engagement 115. The piston handle diaphragm engagement 115 engages the piston diagram 104 at piston diaphragm tips 116. The piston diaphragm tips 116 are connected to an integrally formed with piston diaphragm cups 117. The piston diaphragm cups can be cylinder or cone shaped and fit into piston bracket recesses of the piston bracket 105. As the piston handle shaft 113 rotates, it sequentially depresses piston handle diaphragm engagements 115, which in turn sequentially depress piston diaphragm tips 116, thereby sequentially decreasing a volume of the piston diaphragm cups 117. The piston diaphragm 104 has a flat portion that seals on of the piston bracket 105, so that the piston diaphragm 104 does not rotate relative to the piston bracket 105. The piston bracket 105 also does not rotate relative to the tailstock 108 as the piston bracket 105 is secured to the tailstock 108 by connectors such as screws.

A filter net 103 in a mixer 122 can screen liquid to create rough foam output from the mixer 122. The mixer is separated from the pump area by some distance to prevent backflow of foam into the motor. The output nozzle cover 101 has an air inlet port 120 and an air outlet port 121.

The air generation is used to power and airflow and the airflow enters a mixer 122 where it mixes with liquid soap to create a rough foam via a screen. A rubber stopper 102 can selectively cyclically allow and control admittance of air. The liquid inlet port 119 is connected to the bottle. The rubber stopper 102 can act as a one-way valve, and also the air inlet port 120 preferably includes a one-way valve so as to prevent leakage. The air inlet port 120 can have a one-way valve installed such as by a plastic sheet, a ball stop, or other type of cyclically engaging seal. No liquid should enter the pump area, and is restricted to only the mixer area. The liquid is likely to leak around the piston diaphragm 104 and destroy the motor should liquid enter the output cover 101. Therefore, it is imperative to maintain the dry condition of the output cover 101. It is preferred that the pump is connected to the mixer by a plastic tubing or otherwise segregated by a one-way flow valve. A foam outlet port 118 expels generated foam created from aspirated air through the air inlet port 120 and the liquid inlet port 119 in the mixer.

It is a feature of the present invention to separate the membrane pump area from the foam mixing area so as to increase longevity of the electromechanical components.

The plastic tubing connecting the components in the present invention is not shown in the drawings for purposes of clarity since the appropriate connections are obvious. For example, components such as the liquid inlet nozzle 71 preferably have a liquid inlet nozzle tubing connector 95 which can be connected by tubing to the liquid inlet port 119.

Figure 11:
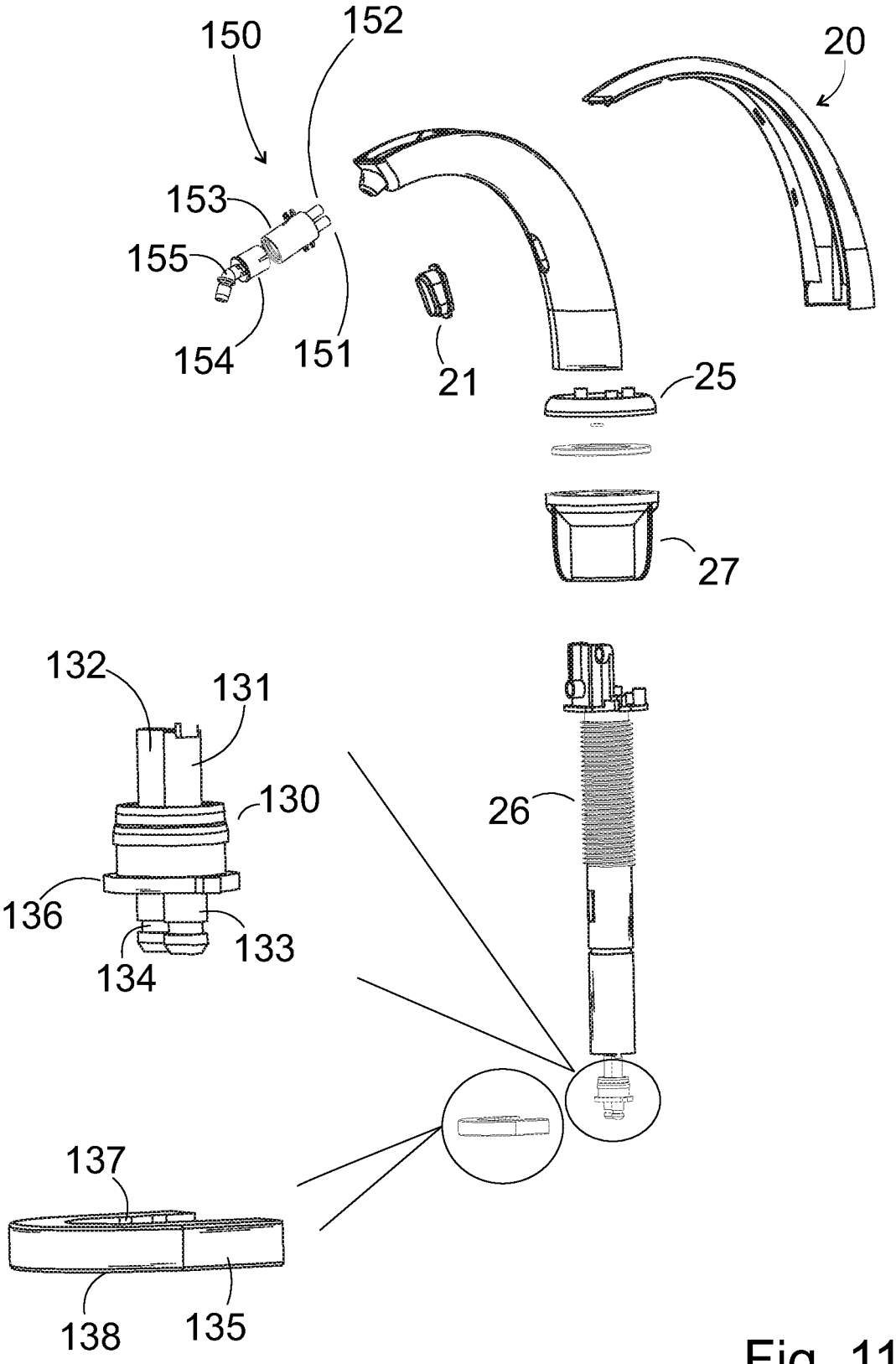
FIG. 11 an exploded view of the present invention.

As seen FIG. 11, the spout 20 may have a spout sensor 21 that is formed on the sidewall of the spout 20. The spout 20 may further receive a spout shoulder 25 that is secured to a spout mounting shaft 26 having an external threaded surface that receives a mounting shaft nut 27. The lower end of the spout mounting shaft 26 has a swivel socket connector 130, which includes a connection to a first swivel hose 131 and a second swivel hose 132. The first swivel hose 131 is in fluid communication with the first swivel nipple 133. The first swivel nipple 133 connects to tubing exiting the pump. The second swivel nipple 134 is in fluid communication with the second swivel hose 132. A swivel socket circlip 135 makes a connection to the swivel socket flange 136 on the swivel socket connector 130. The swivel socket flange 136 is preferably formed as a protrusion extending laterally from cylindrical sidewall of the swivel socket connector 130. The lower circlip edge 138 engages the pump outlet opening flange 139 of FIG. 12 that is formed on the pump outlet opening 42. The upper circlip edge 137 engages the swivel socket flange 136. The swivel socket circlip 135 biases the pump outlet opening flange 139 towards the swivel socket flange 136.

The mixing socket 150 is located at the spout 20 and has a pair of connections where the first mixing socket nipple 151 is connected to the first swivel hose 131 and the second mixing socket nipple 152 is connected to the second swivel hose 132. The mixing socket 150 has a mixing socket body 153 with a cylindrical barrel housing with protruding anchors that engage to the body of the spout 20. The mixing chamber housing 154 can be inserted in the cartridge into the hollow socket of the mixing socket body 153. The mixing chamber housing 14 screens and mixes the liquid and air to form fine foam. A nozzle mount 155 is connected to the mixing chamber housing 154, which inserts into the mixing socket body 153.

Figure 12:
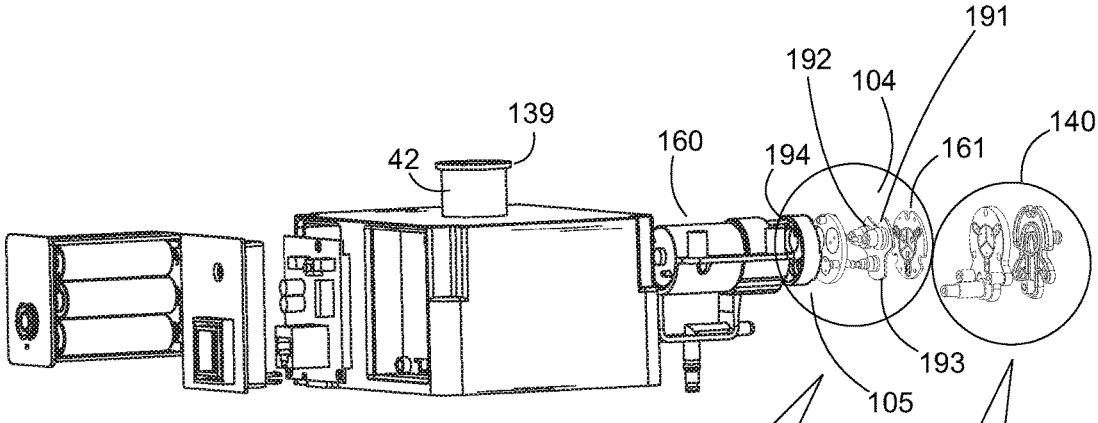
FIG. 12 is an exploded view of the pump.

As seen in FIG. 12, the pump outlet opening 42 has a pump outlet opening flange 139. The pump 160 pumps both liquid and air. The piston diaphragm 104 has two air diaphragms and one liquid diaphragm, which are separated from each other by the piston diaphragm seal 161 so that they operate independently. The pump 160 includes a piston bracket 105 that retains the piston diaphragm 104, piston diaphragm seal 161 and the partition pump manifold 140. The piston diaphragm cups 117 preferably include three cups, a first diaphragm cup 191, a second diaphragm cup 192, and the third diaphragm cup 193.

Figure 13:
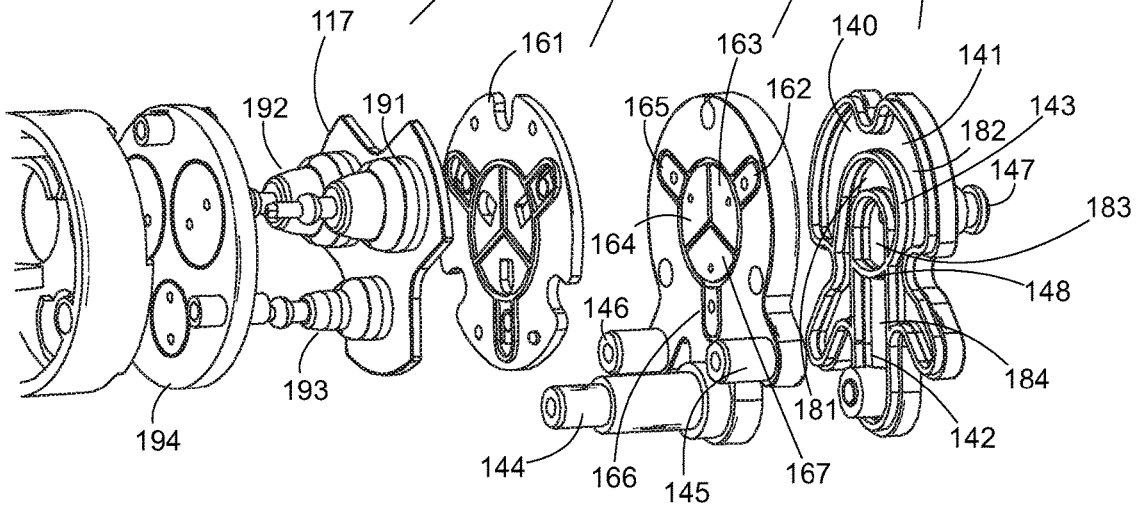
FIG. 13 is an enlarged exploded view of the pump.

As seen in FIG. 13, the partition pump manifold 140 can be formed of a pair of plastic injection molded housings or shells that fit together to form internal conduit passages. An air conduit 141 has an air conduit proximal portion 181, and an air conduit distal portion 182. Similarly, the liquid conduit 142 has a liquid conduit proximal portion 183 and a liquid conduit distal portion 184. The air conduit proximal portion 181 is separated from the air conduit distal portion 182 by the air partition 143. The air partition 143 extends to a liquid partition 148, which separates the liquid conduit proximal portion 183 from the liquid conduit distal portion 184.

The first liquid port 144 is in fluid communication with the second liquid port 147 such that liquid is pumped from the first liquid port 144 to the second liquid 147, or liquid can be pumped from the second liquid port to the first liquid port. The first liquid port is connected to the liquid conduit distal portion 184 of the liquid conduit 142, and the second liquid port 147 is connected to the liquid conduit proximal portion 183. A reciprocating diaphragm pumps the liquid from the liquid conduit distal portion 184 to the liquid conduit proximal portion 183, or pump the liquid from the liquid conduit proximal portion 183 to the liquid conduit distal portion 184. Reciprocating diaphragm Similarly, the first air port 145 is in fluid communication with the second air port 146 so that air is pumped from the first air port 145 to the second air port 146, or from the second air port 146 to the first air port 145. The liquid and air hoses can connect to the ports. The first diaphragm distal air opening 162 passes to the air conduit distal portion 182 and the first diaphragm proximal air opening 163 passes to the air conduit proximal portion 181. The first diaphragm exchanges air between the first diaphragm distal opening 162 and the first diaphragm proximal opening 163. The second diaphragm exchanges air between the second diaphragm proximal air opening 164 and the second diaphragm distal air opening 165. The second diaphragm proximal air opening 164 connects to the air conduit proximal portion 181, and the second diaphragm distal air opening 165 connects the air conduit distal portion 182. The openings can receive a one-way valve or seal 161 that allows air or liquid to pass in a particular direction. The seal 161 can also be integrally formed as a gasket having an elastomeric material composition. The seal 161 can be an intermittent seal that seals air or liquid from passing through a particular opening in a particular direction. If the seal 161 is formed as a plastic flap on a sheet that blocks the first diaphragm proximal air opening 163, the decrease in volume of the third piston of the piston diaphragm 104 would push air through the first diaphragm distal air opening 162. A subsequent increase in volume of the third piston of the piston diaphragm would draw air through the first diaphragm proximal air opening 163 by separating the plastic flap from the opening to allow a gap for airflow. Instead of a plastic flap, the intermittent valves could be implemented as ball bearings or other means.

The third diaphragm of the piston diaphragm seal 104 pumps liquid between the third diaphragm distal liquid opening 166 and the third diaphragm proximal liquid opening 167. The third diaphragm distal liquid opening 156 is connected to the liquid conduit distal portion 184, and third diaphragm proximal liquid opening 167 is connected to the liquid conduit proximal portion 183. Optionally, an adapter 194 can adapt the cup openings to the seal 161 when mounted the cup openings and the seal.

Note that the adapter 194 is shown in FIG. 13 as the pump housing and the piston diaphragm cups, however this is only for showing that the alignment of the circular seals of the piston diaphragm cups 117 align to the circular seals on the adapter 194. The adapter 194 when installed is actually on the backside of the piston diaphragm cups 117 so that the circular seals of the adapter 194 are aligned to the backside of the piston diaphragm cups 117 to adapt the piston diaphragm cups 117 to the elastomeric seal 161. The piston diaphragm cups 117 are preferably soft and the adapter 194 is preferably rigid. The elastomeric seal 161 is preferably soft and the manifold is preferably a rigid item. Thus, the hard and soft items alternate to provide an improved seal in a sandwich like fashion.

Figure 14:
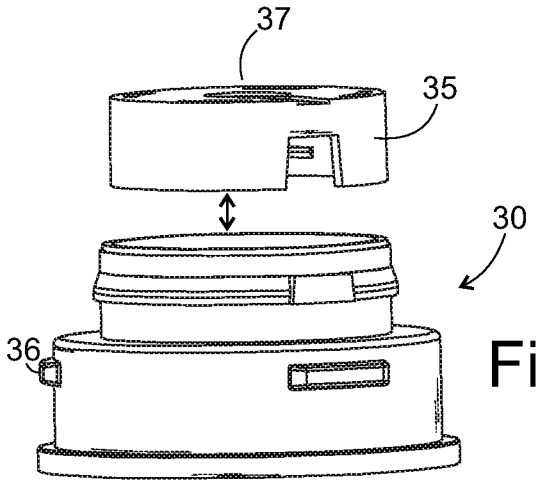
FIG. 14 is an enlarged exploded view of a cap connected to an upper portion of the bottle.
Figure 15:
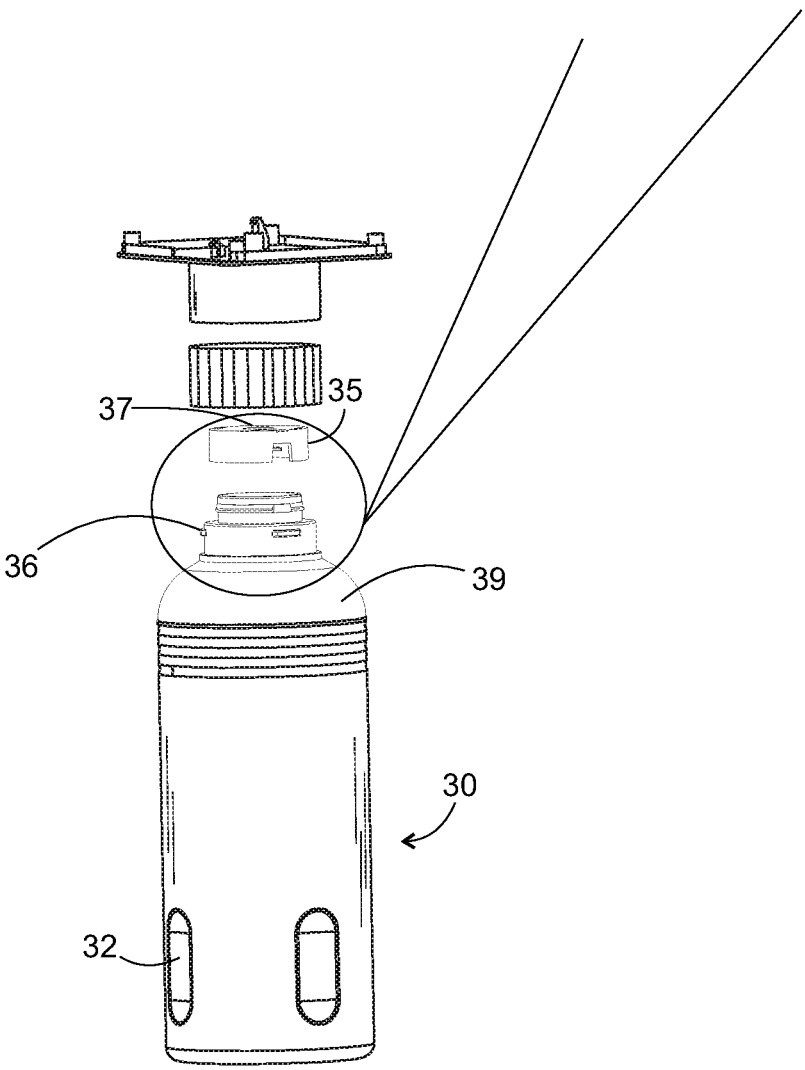
FIG. 15 is an enlarged exploded view of the entire bottle.

As seen in FIG. 14, a bottle 30 has a bottle adapter 35 having an adapter port 37, but the adapter protrusion 36 is formed on the neck of the bottle 30. As seen in FIG. 15, the bottle 30 has a sidewall indent grip 32 that allows the grip for engaging the adapter protrusion 36 formed on the neck of the bottle 30. The adapter protrusion 36 can be formed as lug or locking protrusion that retains the bottle and the bottle adapter 35 to the housing. The adapter port 37 bottle shoulder 39 narrows to a narrow neck.

Thus, the key point of the present invention is that the pump provides a measured output, namely one pulse of liquid, then two pulses of air in a rapid cyclical sequence. The rotary arrangement of the diaphragm cups allows a motor with a rotating shaft to actuate the diaphragm cups in a clockwise or counterclockwise direction, which provides a discrete control over the output. This improves the dosage measurement and thus output consistency while still providing an improved life due to segregation of the liquid from air within the pump. Also, a single motor can provide a synchronized air and liquid dispensing. It is preferred that the liquid diaphragm cup, shown as the third diaphragm cup, is smaller than each of the two air diaphragm cups, shown as the first and second diaphragm cups. The pump outputs a separate stream of liquid and air in a parallel pair of tubes that connect from the air conduit 141 and the liquid conduit 142. The separate streams have a flow with discrete and measured quantity and proportion.

Figure 16:
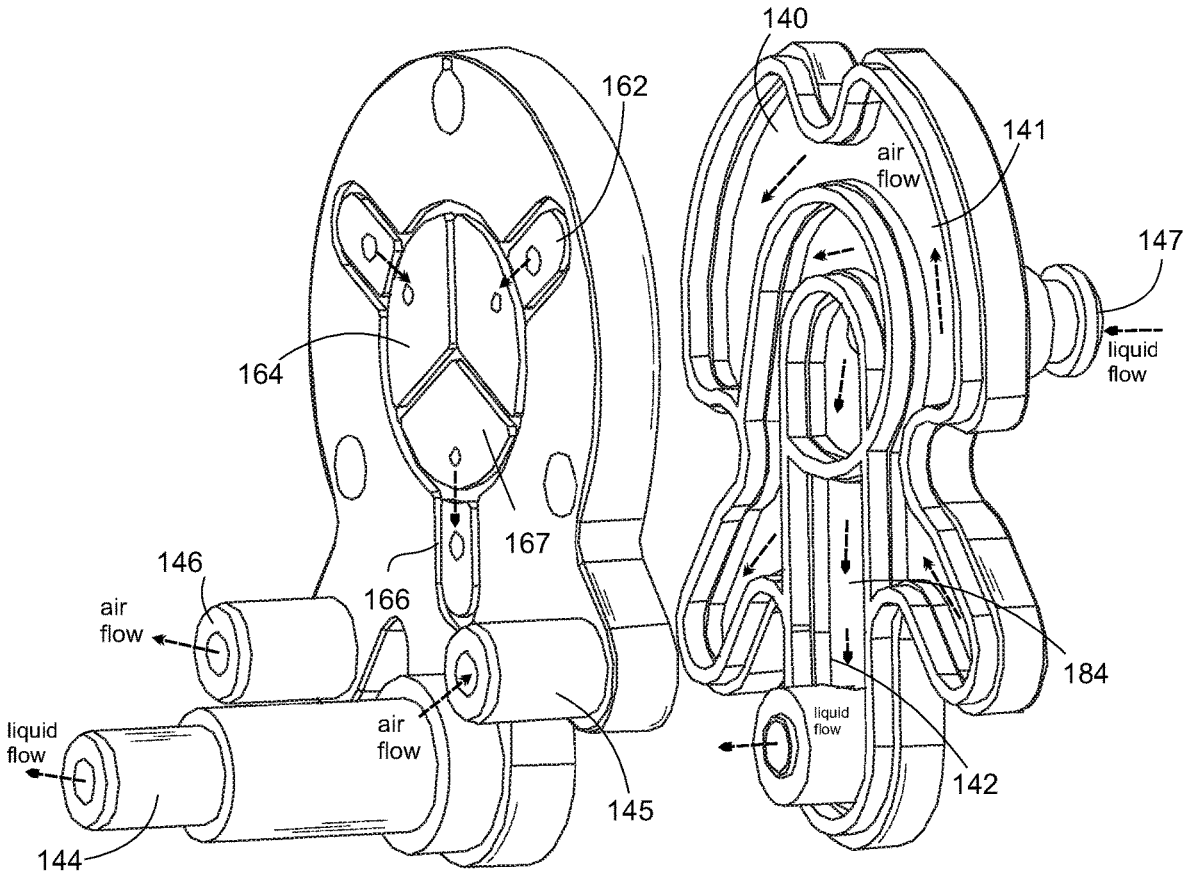
FIG. 16 is an enlarged view showing liquid and airflow through conduits and ports of the manifold.

FIG. 16 shows airflow and liquid flow within the conduits with different style arrows.

The invention claimed is:

1. A bottle for a countermount foam dispenser comprising:

a. a bottle sidewall extending vertically;

b. a shoulder extending from the bottle sidewall at an upper portion of the bottle;

c. a bottle neck extending upwardly from the shoulder, wherein the bottle neck includes a neck groove interrupted by a rotation stop, wherein the rotation stop is formed as a protrusion that protrudes horizontally away from the neck;

d. an adapter mounted to the bottle neck, wherein the adapter has an adapter sidewall, wherein the bottle neck includes adapter protrusions extending away from the bottle neck, wherein the adapter includes adapter hooks configured to permanently snap to the neck groove and form a seal between the neck and the adapter; and e. an adapter gasket having an adapter port opening for forming a seal, wherein the adapter gasket is mounted to an adapter port of the adapter, f. a spout including a spout nozzle with a spout opening;

g. a spout mounting shaft mounted to the spout at a mounting shaft bracket;

h. a mixer pump housing having a spout retainer latch, wherein the mixer pump housing houses a mixer pump, wherein the mixer pump includes a motor, wherein the motor includes a motor shaft, wherein the motor shaft has a crank, wherein the crank actuates a piston handle, wherein the piston handle depresses a piston diaphragm at piston diagram tips, wherein the piston diaphragm tips are configured to change the volume of the piston diaphragm when the piston handle depresses the piston diaphragm, wherein the piston diaphragm is configured to change the pressure against an output cover, wherein the piston diaphragm aspirates air from an air inlet port, and then blows the air to mix the air with liquid soap at a mixer;

i. a partition pump manifold including an air partition and a liquid partition, wherein the liquid partition segments a liquid conduit proximal portion from a liquid conduit distal portion, wherein the air partition segments and air conduit proximal portion from an air conduit distal portion;

j. liquid soap, wherein liquid soap is held within the bottle, wherein the bottle has a connection to the mixer pump housing at the liquid inlet port; and k. batteries located on the mixer pump housing, wherein the batteries power the mixer pump for extracting liquid soap from the bottle, wherein the batteries also power a circuit board mounted in the mixer pump housing, and wherein the batteries also power a sensor, wherein the sensor is mounted to the spout extension front housing.

2. The countermount foam dispenser of claim 1, wherein the mixer pump housing further includes a battery tray for retaining the batteries, wherein the battery tray has a tray door latch cam with a pair of indents, namely a first latch indent and a second latch indent, wherein the pair of indents receive respectively a first key protrusion and a second key protrusion formed on a tray door key, wherein the tray door latch cam travels between a closed position and an open position during a rotation of the tray door latch cam.

3. The countermount foam dispenser of claim 1, wherein the mixer pump housing further includes a bottle adapter receiver frame, wherein the bottle adapter receiver frame includes a bottle adapter receiver with bottle adapter retainer slots, wherein the bottle adapter retainer slots include a bottle adapter intake funnel and a bottle adapter retainer bump.

4. The countermount foam dispenser of claim 1, wherein the mixer pump housing further includes a battery tray for retaining the batteries, wherein the battery tray has a tray door latch cam with a pair of indents, namely a first latch indent and a second latch indent, wherein the pair of indents receive respectively a first key protrusion and a second key protrusion formed on a tray door key, wherein the tray door latch cam travels between a closed position and an open position during a rotation of the tray door latch cam.

5. The countermount foam dispenser of claim 1, wherein the batteries are retained on a battery tray, wherein the battery tray is locked with a battery tray key, wherein the battery tray key rotates the tray door latch cam, wherein the tray door latch cam has a circular profile.

6. The countermount foam dispenser of claim 1, wherein the mixer pump housing further includes an upper alignment indent formed on a bottle adapter receiver frame, wherein the upper alignment indent forms an upper alignment edge; and wherein the bottle further includes a lower alignment indent forming a lower alignment indent edge, wherein the upper alignment edge and the lower alignment edge align when the bottle is in an engaged position.

7. A countermount foam dispenser comprising:

a. a bottle having;

i. a bottle sidewall extending vertically;

ii. a shoulder extending from the bottle sidewall at an upper portion of the bottle;

iii. a bottle neck extending upwardly from the shoulder, wherein the bottle neck includes a neck groove interrupted by a rotation stop, wherein the rotation stop is formed as a protrusion that protrudes horizontally away from the neck;

iv. an adapter mounted to the bottle neck, wherein the adapter has an adapter sidewall, wherein the bottle neck includes adapter protrusions extending away from the bottle neck, wherein the adapter includes adapter hooks configured to permanently snap to the neck groove and form a seal between the neck and the adapter; and v. an adapter gasket having an adapter port opening for forming a seal, wherein the adapter gasket is mounted to an adapter port of the adapter;

b. wherein the counter mount foam dispenser is configured to receive the bottle, wherein the counter mount foam dispenser further comprises:

i. a spout made of a spout extension front housing and a spout extension rear housing, wherein the spout includes a spout nozzle with a spout opening;

ii. a spout mounting shaft mounted to the spout;

iii. a mixer pump housing having a spout retainer latch, wherein the mixer pump housing houses a mixer pump, wherein the mixer pump includes a motor;

iv. a diaphragm, wherein the diaphragm is mounted to the mixer pump, wherein the diaphragm has three diaphragm cups, namely a first diaphragm cup, a second diaphragm cup, and a third diaphragm cup, wherein the first diaphragm cup is configured to pump air, wherein the second diaphragm cup configured to pump air, and wherein the third diaphragm cup is configured to pump liquid, wherein the diaphragm pumps both liquid and air without mixing the liquid with the air;

v. a mixer located in the spout, wherein the mixer receives pressurized air from the mixer pump, wherein the mixer receives pressurized liquid from the mixer pump, wherein the pressurized air and the pressurized liquid mix to form a foam;

vi. liquid soap, wherein the liquid soap is held within the bottle, wherein the bottle has a connection to the mixer pump housing; and vii. batteries located on the mixer pump housing, wherein the batteries power the mixer pump for extracting liquid soap from the bottle, wherein the batteries also power a circuit board mounted in the mixer pump housing, and wherein the batteries also power a sensor, wherein the sensor is mounted to the spout extension front housing.

* * * * *